United States Patent [19]

Marble et al.

[11] Patent Number: 4,917,127

[45] Date of Patent: Apr. 17, 1990

[54] PORTABLE SHELTER

[76] Inventors: Jeffrey P. Marble, 5346 Woodland Dr.; Alvin L. Giese, 825 E. Washington St., both of West Bend, Wis. 53095

[21] Appl. No.: 175,855

[22] Filed: Mar. 31, 1988

[51] Int. Cl.[4] ..... E04H 15/00

[52] U.S. Cl. ..... 135/87; 135/901

[58] Field of Search ..... 135/89, 901; 43/1; 297/180, 192, 217; 280/125

[56] References Cited

U.S. PATENT DOCUMENTS

| | | | |
|---|---|---|---|
| 2,465,147 | 3/1949 | Butler et al. | 135/901 X |
| 2,519,430 | 8/1950 | Brown | 135/902 |
| 2,632,454 | 3/1953 | Skogen | 139/901 X |
| 2,717,160 | 9/1955 | Schmidt | 135/901 |
| 3,017,194 | 1/1962 | Anderson | 135/901 X |
| 3,105,505 | 10/1963 | Maybee | 135/904 |
| 3,157,185 | 11/1964 | Schoenike . | |
| 3,173,436 | 3/1965 | Peters . | |
| 3,224,150 | 12/1965 | Burtoft et al. . | |
| 3,492,015 | 1/1970 | Kuhn et al. . | |
| 3,507,293 | 4/1970 | DuBray | 135/901 X |
| 3,509,891 | 5/1970 | De Bolt . | |
| 3,513,605 | 5/1970 | Smith | 135/901 X |
| 3,744,842 | 7/1973 | Ronning | 135/901 X |
| 3,854,746 | 12/1974 | Flynn et al. . | |
| 3,874,398 | 4/1975 | Hendrickson . | |
| 4,300,253 | 11/1981 | Anderson | 135/901 |
| 4,438,940 | 5/1984 | Hunt . | |
| 4,526,391 | 7/1985 | Winkelman et al. . | |
| 4,631,877 | 12/1986 | Molodecki . | |
| 4,683,672 | 8/1987 | Davis | 135/901 X |

*Primary Examiner*—Henry E. Raduazo

*Attorney, Agent, or Firm*—Foley & Lardner

[57] ABSTRACT

The invention provides a portable shelter including a base, a seat, and a collapsible windscreen assembly which is mounted on the base around the seat. The portable shelter according to the invention can be readily transported over snow or ice, and then set up for winter sports such as ice fishing. In preferred embodiments, the base of the unit defines a storage compartment wherein the windscreen assembly can be stowed when not in use. A cushioned seat functions as the lid for the storage compartment. According to an additional aspect of the invention, the seat is disposed in parallel to the bottom wall of the base which supports the unit so that the unit need not be turned on end prior to use.

14 Claims, 2 Drawing Sheets

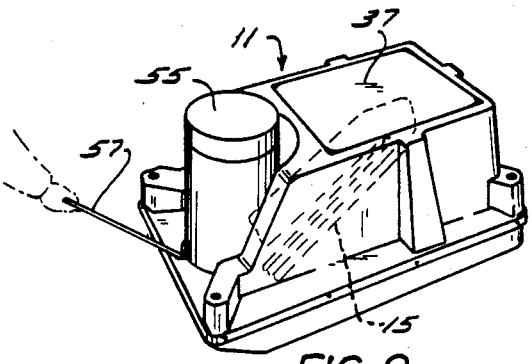
FIG. 2
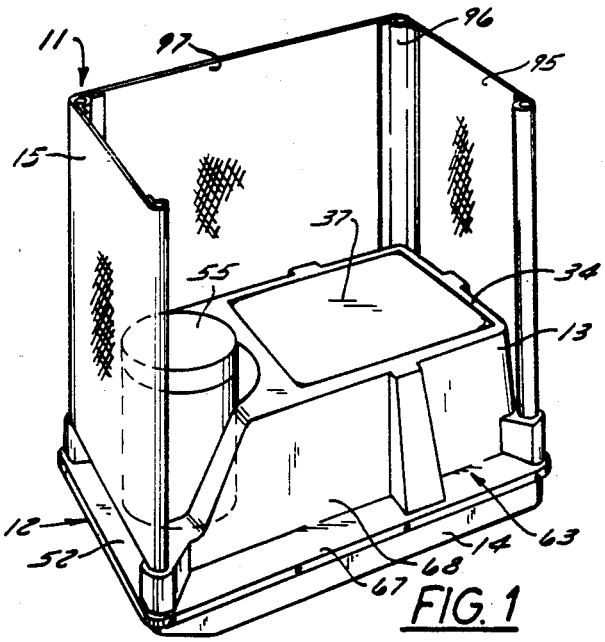
FIG. 1
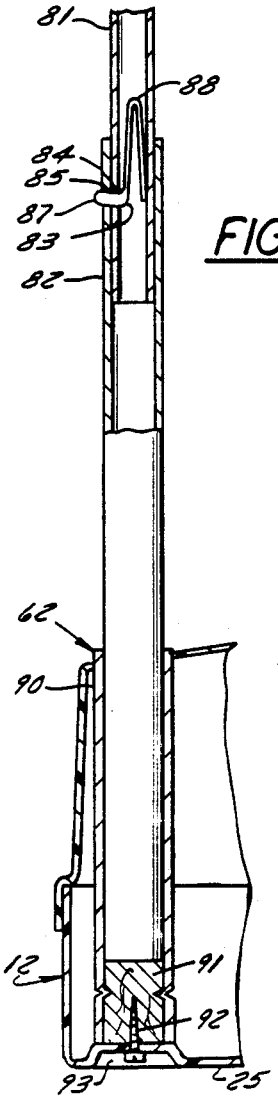
FIG. 7
FIG. 3
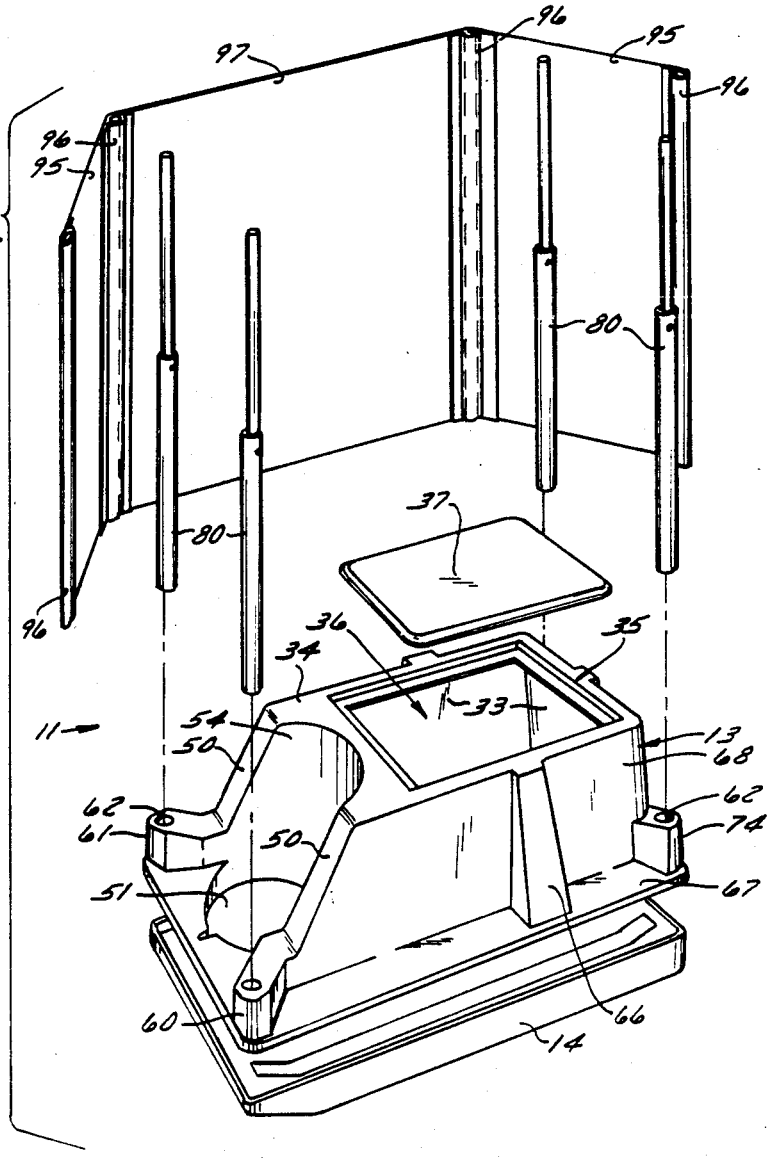

PORTABLE SHELTER

TECHNICAL FIELD

This invention relates to portable shelters, particularly ice fishing shelters which can be collapsed and transported manually over winter terrain.

BACKGROUND OF THE INVENTION

Sportsmen have historically used small huts or shelters for protection against adverse weather conditions often associated with winter sports such as ice fishing. In particular, ice fishermen customarily build small, ice fishing shacks on the surface of a frozen pond or lake and then fish through a hole cut through the ice within the shack. A typical ice fishing hut is relatively large and is not portable, i.e. it must be erected on the ice of a frozen lake, then disassembled and removed at the end of the ice fishing season.

Portable shelters provide an alternative to conventional ice fishing huts or shanties. Portable ice fishing shelters are, in general, known, as exemplified by Burtoft U.S. Pat. No. 3,224,150 issued Dec. 21, 1965. Some such shelters generally resemble tents which can be erected at the ice fishing site. See, for example, Debolt U.S. Pat. No. 3,509,891 issued May 5, 1970 and Hendrickson U.S. Pat. No. 3,874,398 issued Apr. 1, 1975.

Other portable shelters have been proposed which combine the features of a collapsible hut with a sled for transporting the unit over the ice. Schoenike U.S. Pat. No. 3,157,185 issued Nov. 17, 1964, Flynn U.S. Pat. No. 3,854,746 issued Dec. 17, 1974 and Molodecki U.S. Pat. No. 4,631,877 issued Dec. 30, 1986 exemplify such collapsible shelters. Still other collapsible portable shelters have been proposed wherein the unit is turned on end prior to use. See, for example, Kuhn U.S. Pat. No. 3,492,015 issued Jan. 27, 1970, Peters U.S. Pat. No. 3,173,436 issued May 16, 1965, Winkelman et al U.S. Pat. No. 4,526,391 issued July 2, 1985 and Hunt U.S. Pat. No. 4,438,940 issued Mar. 27, 1984.

Such prior portable, collapsible shelters suffer from a variety of disadvantages. Most prior shelters are large, cumbersome and difficult to set up. Turning the unit on end manually may be required. The present invention addresses these disadvantages and provides a portable collapsible shelter having additional advantageous features.

SUMMARY OF THE INVENTION

The present invention provides a portable, collapsible shelter which can be readily transported over ice or snow. The portable shelter according to the invention includes a base provided with a seat, and a collapsible windscreen assembly which can be erected on the base. According to a preferred aspect of the invention, the seat is parallel to the bottom support surface of the base, permitting the unit to be used without first changing its positional orientation, i.e., turning it on end. According to a further aspect of the invention, the base includes an internal chamber for convenient storage of the windscreen components and optionally other items, such as fishing equipment.

BRIEF DESCRIPTION OF THE DRAWINGS

A preferred exemplary embodiment of the invention will hereinafter be described in conjunction with the appended drawings, wherein like numerals denote like elements, and:

FIG. 1 is a perspective view of a collapsible shelter according to the invention, shown with the windscreen assembly erected;

FIG. 2 is a perspective view of the collapsible shelter shown in FIG. 1, wherein the windscreen assembly has been collapsed and stored for transport;

FIG. 3 is an exploded perspective view of the collapsible shelter shown in FIG. 1;

FIG. 7 is a partial sectional view taken along the line 7—7 in FIG. 6;

DETAILED DESCRIPTION OF A PREFERRED EMBODIMENT

Referring now to FIG. 1, a portable shelter 11 in accordance with the present invention suitably comprises a generally polyhedral, hollow base 12 made from a pair of upper and lower mating shells 13 and 14, respectively, and a collapsible windscreen assembly 15. Each of these components is described in detail hereafter.

Figure 5:
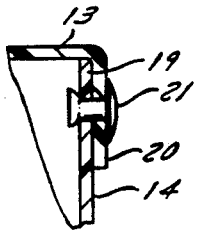
FIG. 5 is a partial sectional view taken along the line 5—5 in FIG. 4.

As shown in FIGS. 1 through 6, base 12 of shelter 11 comprises a lower, upwardly opening trayshaped shell 14 which fits inside a bottom peripheral vertical flange 20 of upper shell 13. An upper peripheral edge 19 of lower shell 12 is secured to flange 20 by suitable fasteners, e.g., rivets 21, as shown in FIG. 5. Upper and lower shells 13, 14 are both preferably made of a suitable rigid, strong, lightweight plastic so that base 12 can support at least the weight of a person. Base 12 can be formed from a single molded piece of plastic instead of being molded in two pieces as in the embodiment shown.

Base 12 is preferably generally rectangular in shape. However, a bottom wall 25 of base 12, as defined by the undersurface of lower shell 14, has generally greater dimensions than the corresponding portion of top wall 34 parallel thereto in order to provide a suitable base of support for a seat 37, as described further below.

Figure 9:
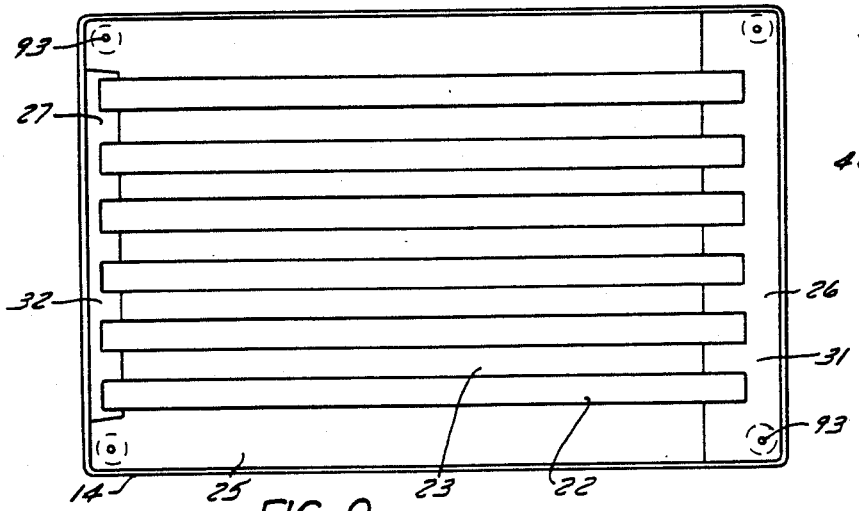
FIG. 9 is a bottom plan view of the portable shelter shown in FIG. 1.
Figure 10:
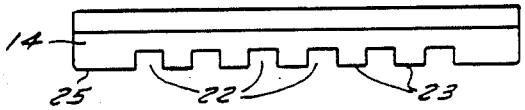
FIG. 10 is an end elevational view of the lower shell shown in FIG. 3.

Referring to FIGS. 9 and 10, lower shell 14 has a series of spaced, lengthwise, parallel indentations 22 which define a series of integral runners 23 therebetween which extend nearly the entire length of base 12. Runners 23, which form part of bottom wall 25, support base 12 for sliding movement over ice or snow. Bottom wall 25 of base 12 further preferably has a pair of sloped front and rear end faces 26 and 27, respectively, which taper upwardly towards peripheral edge 19 (see FIGS. 1, 3 and 4) so that base 12 can be drawn along snow or ice like a conventional sled. Sloped faces 26, 27 provide runners 23 with sloped front and rear end faces 31, 32, respectively.

Upper shell 13 is secured to lower shell 14 in the manner described above to form an internal storage chamber 33 within base 12. A top wall 34 of upper shell 13 has an access opening 36 therein. Opening 36 is preferably located in a flat, topmost portion 35 of top wall 34 which is generally parallel to bottom wall 25.

In the illustrated embodiment, access opening 36 has approximately the same dimensions as a removable cushioned seat 37 which fits therein. As shown in detail in FIG. 8, seat 37 preferably comprises a flat board 41 which has sufficient strength to support a person, a foam cushion 42 disposed thereon, and a moisture impervious flexible cover 43. Cover 43 is wrapped around the top and sides of cushion 42 as shown, and is secured by suitable means, e.g. an adhesive or a series of fasteners, to the outer periphery of one face of board 41.

Figure 8:
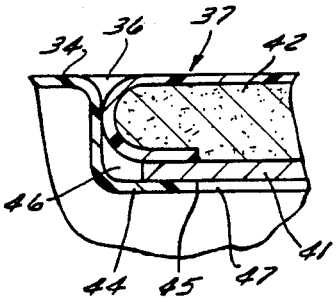
FIG. 8 is a partial sectional view taken along the line 8—8 in FIG. 6.

Opening 36 has a horizontal step 44 which defines a recess 46 into which seat 37 fits. Board 41 of seat 37 is preferably rectangular, and has slightly greater dimensions than the inner periphery 45 of horizontal step 44, so that seat 37 rests against step 44 as shown in FIG. 8. Seat 37 thereby completely covers an inner opening 47 defined by the inner periphery 45 of horizontal step 44. However, opening 36 has slightly greater dimensions than seat 37 so that a user can readily grasp and remove seat 37 to access chamber 33 through inner opening 47.

Upper shell 13 of base 12 has several additional features. Top wall 34 divides to form a pair of diverging, frontwardly and downwardly sloping arms 50 which have a partial cylindrical recess 51 therebetween. A front wall 52 of base 12 having a lesser slope than arms 50 forms part of a generally cylindrical peripheral wall 53 which defines recess 51. Optionally, wall 53 can include an inwardly centered, crescentshaped, truncated conical portion 54 which increases in radius in the outward (upward) direction. Truncated conical portion 54 renders easier the insertion of a container such as a bait bucket 55 into recess 51. Front wall 52 may further have a central notch 56 therein adjacent the outermost end of recess 51 for receiving a knotted end of a draw rope 57, as illustrated in FIG. 2.

Arms 50 end in a pair of front corner posts 60 directed at approximately a 45° angle relative to the associated lower front corners 61 of base 12. Each front corner post 60 has an upwardly opening socket 62 therein near the associated corner 61, which socket 62 is used in assembling windscreen assembly 15 as described hereafter.

Figure 4:
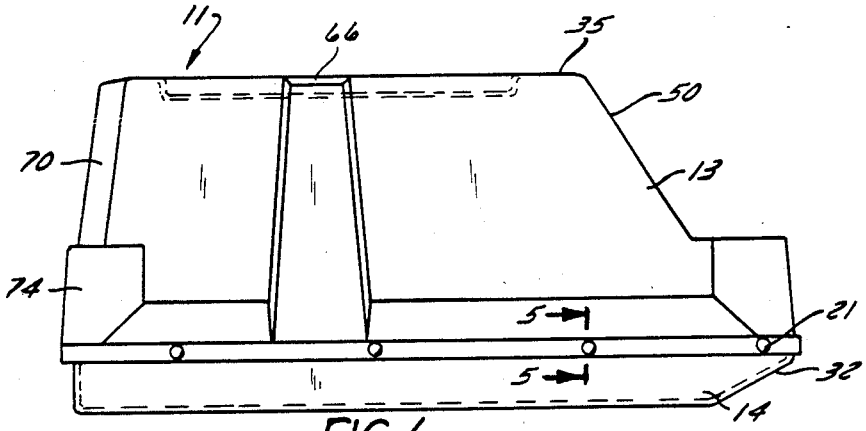
FIG. 4 is a side elevational view of the portable shelter shown in FIG. 1, with the windscreen assembly removed.
Figure 6:
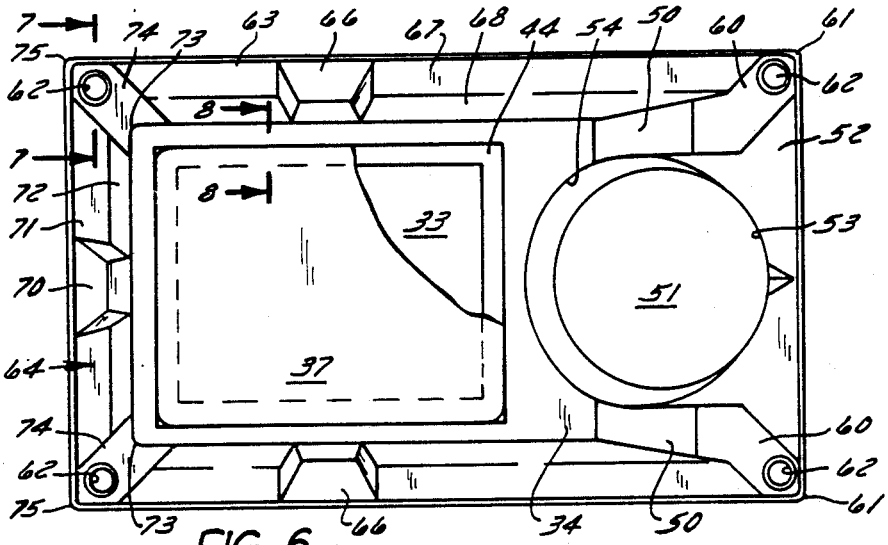
FIG. 6 is a top plan view of the collapsible portable shelter shown in FIG. 1 with the windscreen assembly removed and the seat partly broken away.

Referring to FIG. 6, upper shell 13 of base 12 further has a pair of substantially identical side walls 63 and a rear wall 64. Side walls 63 may optionally include a pair of medial reinforcing buttresses 66, generally prismatic in shape, which provide additional strength and support for carrying loads on top of base 12, e.g., additional heavy equipment. Each of walls 63 preferably comprises an essentially horizontal outer shelf portion 67 and a steep, approximately vertical inner face 68. Shelves 67 aid in providing an enlarged base of support for seat 37.

Rear wall 64 is comparable in structure to side walls 63, i.e., it can include an optional reinforcing buttress 70, a generally horizontal outer shelf 71 and a substantially vertical inner face 72. Side walls 63 meet with back wall 64 at associated upper corners 73. A pair of rear corner posts 74 extend laterally from the base of corners 73 to corresponding lower rear corners 75 of base 12. Rear corner posts 74 have substantially the same shape as front corner posts 60 and provide an additional pair of sockets 62 therein.

Windscreen assembly 15 includes a series of collapsible poles 80 corresponding in number to sockets 62. In the illustrated embodiment, four collapsible poles 80 are provided which are slidably, closely received in sockets 62. As shown in detail in FIG. 7, each pole 80 may suitably comprise a pair of inner and outer telescoping tubular sections 81, 82, respectively, which can be releasably locked in an extended position by means of a spring catch 83. Catch 83 releasably engages a pair of corresponding, alignable holes 84, 85 in each of tubular sections 81, 82, respectively. Catch 83 comprises a button portion 87 which extends outwardly through holes 84, 85 and a rear, leaf spring portion 88 which engages the inner surface of upper tubular section 81 for resiliently urging button 87 outwardly through hole 84.

Referring again to FIG. 7, each of sockets 62 suitably comprises a tubular metal sleeve 90 having a plug 91 of cork or similar material 91 inserted securely therein at one end thereof. A fastener such as a screw 92 is inserted inwardly through a suitable hole in bottom wall 25 of base 12 into plug 91 to secure socket assembly 62 to base 12. The bottom end of pole 80 engages plug 91 when pole 80 is fully inserted into socket 62. Bottom wall 25 preferably has a shallow indentation 93 at the location of each fastener 92, so that fasteners 92 will not hinder sliding movement of base 12.

Windscreen 95 is a flexible, generally rectangular piece of canvas, plastic or similar sheet material. Windscreen 95 includes suitable means for mounting windscreen 95 on poles 80, such as a series of parallel, spaced-apart sleeves 96 which are positioned and configured to fit over associated poles 80 to provide a three-sided wind break as shown in FIG. 1. Windscreen 95 and sleeves 96 are advantageously slightly shorter than poles 80 by a distance equal to the length of the end portion of each pole 80 that fits into a socket 62.

The illustrated embodiment of portable, collapsible shelter 11 according to the invention is used as follows. When not in use, windscreen assembly 15 is rolled up and placed inside chamber 33 as shown in FIG. 2. Bait bucket 55 is filled with bait and stowed in recess 51. Shelter 11 may then be drawn by rope 57 to a suitable site for ice fishing, i.e., out onto a frozen pond or lake. Upon reaching the desired site, the user removes seat 37 and takes out windscreen assembly 15. The lower ends of each of the poles 80 are then inserted into the corresponding sockets 62 at the four corners of base 12. Then, if not preassembled, windscreen 95 may be set up by sliding each of sleeves 96 over the corresponding poles 80. Seat 37 is then replaced, and shelter 11 is positioned so that the central panel 97 of windscreen assembly 15 is interposed between seat 37 and the wind. The user then sits on seat 37 at the open side of shelter 11, i.e., the side not covered by windscreen assembly 15. The user can then sit comfortably and ice fish, using bait bucket 55 as needed, with protection from the wind.

When the user decides to leave, poles 80 are withdrawn from sockets 62, and windscreen assembly 15 is stowed away inside chamber 33 so that the portable shelter 11 again assumes the state shown in FIG. 2. The user grasps rope 57 and pulls portable shelter 11 away. There is no need to leave the shelter all winter on the frozen pond or lake, and portable shelter 11 can be easily moved if the intrepid angler decides to find a new place to fish.

The portable shelter 11 of the preceding embodiment combines several functions and advantages in a unit which has a minimal number of essential parts. Base 12 provides the functions of a sled and seat. It additionally has an internal chamber for storing the windscreen assembly, and an outer recess in which a container, such as a bait bucket, can be stored. The preferred windscreen assembly according to the invention includes only a plurality of collapsible telescoping poles and a flexible windscreen, together with means for mounting the windscreen on the poles, such as the sleeves 96 described. Windscreen assembly 15 thus has only a few simple parts and can be readily set up and taken down as needed. Seat 37 of portable shelter 11 also functions as a lid for storage chamber 33. The portable shelter 11, according to the invention, thereby provides a variety of useful functions with a minimum of complex mechanical parts, and can be used without need for turning base 12 on end.

The foregoing description is of a preferred exemplary embodiment of the invention, and the invention is not limited to the specific forms shown. Persons skilled in the art will appreciate that various substitutions, modifications and changes in the design or arrangement of the elements may be made without departing from the spirit of the invention as expressed in the appended claims.

We claim:

1. A portable shelter, comprising:

a base having a pair of generally parallel top and bottom walls, means defining a storage compartment, and a plurality of upwardly opening sockets disposed in spaced apart positions near the periphery of said base, said top wall having an opening therein which communicates with said storage compartment, and a stepped recess surrounding said opening;

a seat removably disposed in said recess and covering said opening, said seat including a rigid board, a cushion disposed on one face of said board, and a flexible cover secured to said board over said cushion;

downwardly directed runners disposed on said bottom wall of said base for: supporting said base for movement over a surface; and a removable windscreen assembly configured to fit through said opening for storage within said storage compartment, including a plurality of poles insertable into said sockets, a flexible sheet, and means for mounting said sheet on said poles, said assembly being configured to provide a windscreen for said seat when in an assembled, upright position wherein said end portions of said poles are inserted in said sockets and said sheet is mounted on said poles.

2. A portable shelter comprising:

a base having a bottom wall, a top wall, and a storage chamber therein, said top wall having an opening communicating with said storage chamber;

a seat removably disposed on said top wall and closing said opening;

a collapsible wind screen assembly which can fit through said opening into said storage chamber when in a collapsed state, said assembly comprising a plurality of poles, a flexible sheet, and means for mounting said sheet on said poles; and said base further comprising a plurality of sockets for receiving end portions of said poles to support said wind screen assembly in an upright, assembled position.

3. The portable shelter of claim 2, wherein each of said poles comprises a plurality of telescoping tubular sections, and means for releasably locking said sections in an extended position.

4. The portable shelter of claim 2, wherein said means for mounting said sheet comprises a series of elongated, spaced parallel sleeves disposable over said poles.

5. A portable shelter comprising:

a base having a bottom wall, a top wall, a plurality of side walls spanning said top and bottom walls, and a storage chamber therein, said top wall having an opening communicating with said storage chamber;

a seat removably disposed on said top wall and closing said opening;

a collapsible windscreen assembly which can fit through said opening into said storage chamber when in a collapsed state; and means for removably mounting said windscreen assembly on said base at a position offset from said seat.

6. The portable shelter of claim 5, further comprising recessed step means in said top wall of said base for retaining said seat.

7. The portable shelter of claim 5, wherein said seat comprises a rigid board, a cushion disposed on a face of said board, and a flexible cover secured to said board over said cushion.

8. The portable shelter of claim 5, wherein said bottom wall has runners thereon.

9. The portable shelter of claim 5, wherein said side walls slope outwardly from said top wall.

10. A portable shelter, comprising:

a generally rectangular base having a pair of generally parallel top and bottom walls, a plurality of upwardly opening sockets disposed in spaced apart positions near the periphery of said base proximate four corners of said base, and a plurality of side walls which span said top and bottom walls and slope outwardly from said top wall and are disposed inwardly from said sockets;

a seat substantially centrally disposed on said top wall of said bore;

downwardly directed means disposed on said bottom wall of said base for supporting said base for movement over a surface; and a removable windscreen assembly including a plurality of poles having end portions removably insertable into said sockets, a flexible sheet, and means for mounting said sheet on said poles to provide a windscreen for said seat when said end portions of said poles are inserted in said sockets and said sheet is mounted on said poles.

11. The shelter of claim 10, wherein said supporting means comprises a series of runners.

12. The shelter of claim 10, wherein said base is generally rectangular, said seat is substantially centrally disposed on said top wall, and said sockets are disposed proximate four corners of said base.

13. A portable shelter comprising:

a base having a pair of generally parallel top and bottom walls, a plurality of upwardly opening sockets disposed in spaced apart positions near the periphery of said base proximate four corners of said base, a seat disposed on said top wall of said base, said base further having an upward extending conical wall defining a recess at the side of said seat configured to receive and removably retain a container therein;

downwardly directed means disposed on said bottom wall of said base for supporting said base for movement over a surface; and a removable windscreen assembly including a plurality of poles having end portions removably insertable into said sockets, a flexible sheet, and means for mounting said sheet on said poles to provide a windscreen for said seat when said end portions of said poles are inserted in said sockets and said sheet is mounted on said poles.

14. The portable shelter of claim 13, wherein said flexible sheet is substantially impervious to air currents and is dimensioned to overlie each of said poles over a major portion of the length of each pole to effectively shield a user seated on said seat from wind blowing in at least one direction.

* * * * *